US005685065A

United States Patent [19]

Suzuki et al.

[11] Patent Number: 5,685,065

[45] Date of Patent: Nov. 11, 1997

[54] METHOD OF MAKING AN IGNITION COIL

[75] Inventors: Toshiro Suzuki, Nissin; Koji Yoshikawa, Obu, both of Japan

[73] Assignee: Aisan Kogyo Kabushiki Kaisha, Obu, Japan

[21] Appl. No.: 507,521

[22] Filed: Jul. 26, 1995

[30] Foreign Application Priority Data

Aug. 2, 1994 [JP] Japan ..... 6-201476

[51] Int. Cl.[6] ..... H01F 7/127; H01F 17/06; H01F 27/24

[52] U.S. Cl. ..... 29/606; 29/609; 123/634; 336/110; 336/178; 336/216

[58] Field of Search ..... 29/605, 606, 609; 123/634; 336/96, 107, 110, 165, 178, 212, 233, 234

[56] References Cited

U.S. PATENT DOCUMENTS 2,844,786 7/1958 Urk et al. .
4,546,753 10/1985 Pierret .
4,658,799 4/1987 Kusaka et al. .
4,849,728 7/1989 Goll et al. .
4,926,152 5/1990 Ito et al. .
4,990,881 2/1991 Ooyabu .
5,044,328 9/1991 Umezaki .
5,257,611 11/1993 Chapekis et al. ..... 29/606 X

FOREIGN PATENT DOCUMENTS

A-6-84666 3/1994 Japan .

*Primary Examiner*—Timothy V. Eley
*Attorney, Agent, or Firm*—Oliff & Berridge

[57] ABSTRACT

An inner core for an ignition coil is inserted into a bobbin, around which a primary winding and a secondary winding are disposed. An outer core is inserted into a housing to form a magnetic circuit with the inner core. A magnet member, which is made of a permanent magnet material such as $Sm_1Co_5$, is connected to the inner core. The bobbin, which is assembled with the inner core, the magnet member, the primary and secondary windings, is inserted into the housing, with the magnet member positioned between the inner core and the outer core, and then the inside of the housing is molded by a synthetic resin. Thereafter, the magnet member is magnetized to provide a predetermined magnetic force. The magnet member may be molded by $Sm_1Co_5$ to form a plate having a thickness of 1.5 mm and more.

5 Claims, 3 Drawing Sheets

METHOD OF MAKING AN IGNITION COIL

BACKGROUND OF THE INVENTION

1. Field of the Invention

The present invention relates to a method of making an ignition coil for use in an internal combustion engine, and more particularly to an ignition coil having a permanent magnet disposed in a magnetic circuit.

2. Description of the Related Art

A conventional ignition coil for an internal combustion engine is provided with a primary winding and a secondary winding which are disposed around a core respectively. The primary winding is electrically connected to a control circuit for controlling a primary current, and the secondary winding is electrically connected to an ignition plug through a high-tension terminal. That is, the opposite ends of the wire of the primary winding are electrically connected to a pair of primary terminals, respectively, while one end of the wire of the secondary winding is electrically connected to the primary terminal and the other end is electrically connected to the high-tension terminal.

As for the ignition coil for the internal combustion engine as described above, it is disclosed in the U.S. Pat. No. 4,990,881, for example, that a permanent magnet is disposed in a closed magnetic circuit to increase energy stored in an ignition coil. Also, in Japanese Patent Laid-open Publication No. 6-84666, there is disclosed an ignition coil for an internal combustion engine, which is made small in size with a permanent magnet supported properly to ensure a stable ignition property.

In the above-described ignition coil having a permanent magnet disposed in a magnetic circuit, the permanent magnet has been formed very thin, so that it is difficult to produce the permanent magnet by sintering a magnet material. For example, the permanent magnet as disclosed in U.S. Pat. No. 4,990,881 is made as thin as 0.6 to 1.8 mm, so that the magnet can not be produced by sintering the material. Generally, it is produced by cutting a block of permanent magnet material into a slice having a predetermined thickness. Therefore, in order to cut out a 1 mm thick magnet from the magnet material block, it is necessary to provide another 1 mm thick portion. That is, at least 2 mm thick magnet material is necessitated for producing each magnet having a thickness of 1 mm, which causes a waste of magnet material to result in increase in cost. Furthermore, such a thin magnet as described above is easily broken, and therefore it is difficult to handle the magnet in assembling the ignition coil, which results in decrease in productivity.

According to the ignition coil on the market, a permanent magnet material of 2–17 samarium-cobalt ($Sm_2Co_{17}$) is used for the permanent magnet disposed in the magnetic circuit. This magnet material consists of 25% Sm, 50% Co, 15% Fe by mass and the rest including Cu and other additives, and it is formed into a predetermined configuration, and magnetized in advance to produce a permanent magnet, and then the permanent magnet is installed in a housing. After the permanent magnet is assembled in the housing, a molding resin or a thermosetting resin is filled in the housing. However, the magnet material ($Sm_2Co_{17}$) has such a magnetizing property as indicated by a phantom line in FIG. 4, so that it is difficult to magnetize this magnet material after the molding resin was filled in the housing. If this magnet material is to be magnetized after the molding resin was filled, an extremely large power source for magnetizing the material (e.g., with dimensions of 5 m by 5 m by 2 m) is necessitated, which will be impractical. Therefore, a permanent magnet which has been magnetized in advance has to be used before assembling the same into a housing of an ignition coil, while it is difficult to install the permanent magnet in the housing, because the permanent magnet is attracted by other parts and sometimes broken when the former is removed from the latter. If the permanent magnet with iron powder or the like attracted thereto is assembled into the ignition coil, its ignition property might be deteriorated.

SUMMARY OF THE INVENTION

It is, therefore, an object of the present invention to provide a method of making an ignition coil having a core for providing a magnetic circuit, a primary winding and a secondary winding disposed around the core, and a permanent magnet disposed in the magnetic circuit, whereby the permanent magnet can be produced at a low cost, and easily installed to ensure a stable ignition property.

In accomplishing the above and other objects, an ignition coil is made by a method which includes the steps of (1) forming a core for providing a magnetic circuit, (2) disposing a primary winding and a secondary winding around the core, (3) disposing a magnet member made of a permanent magnet material in the magnetic circuit, (4) inserting the core, the primary winding, the secondary winding and the magnet member into a housing, (5) molding a synthetic resin within the housing, (6) and subsequently magnetizing the magnet member to provide a predetermined magnetic force.

Preferably, the method further includes the step of forming the magnet member as a plate which is made of a permanent magnet material of 1–5 samarium-cobalt ($Sm_1Co_5$) which has 36% Sm and 64% Co by mass.

The method may further include the step of sintering the permanent magnet material of $Sm_1Co_5$ to form the magnet member as the plate having a thickness of 1.5 mm and more.

An ignition coil may be made by a method which includes the steps of (1) forming an inner core and an outer core for providing a magnetic circuit together therewith, (2) inserting the outer core into a housing, (3) inserting the inner core into a bobbin, (4) disposing a primary winding and a secondary winding around the bobbin, (5) connecting a magnet member which is made of a permanent magnet material to the inner core, (6) inserting the bobbin, which is assembled with the inner core, the magnet member, the primary winding and the secondary winding, into the housing, so that the magnet member is positioned between the inner core and the outer core, (7) molding a synthetic resin within the housing, (8) and subsequently magnetizing the magnet member to provide a predetermined magnetic force.

Accordingly, may be produced an ignition coil which includes an inner core and an outer core for forming a magnetic circuit together therewith, a bobbin which has a cylindrical portion for receiving therein the inner core, a primary winding and a secondary winding which are wound around the bobbin, a housing which receives the outer core, and accommodates therein the bobbin which is associated with the inner core, the primary winding and the secondary winding, and a molding resin which is filled in the housing. The ignition coil further includes a magnet member which is made of a permanent magnet material of $Sm_1Co_5$, and disposed between the inner core and the outer core before the molding resin is filled in the housing, and which is magnetized after the molding resin was filled in the housing.

BRIEF DESCRIPTION OF THE DRAWINGS

The above stated object and following description will become readily apparent with reference to the accompanying drawings, wherein like reference numerals denote like elements, and in which.

DESCRIPTION OF THE PREFERRED EMBODIMENT

Figure 1:
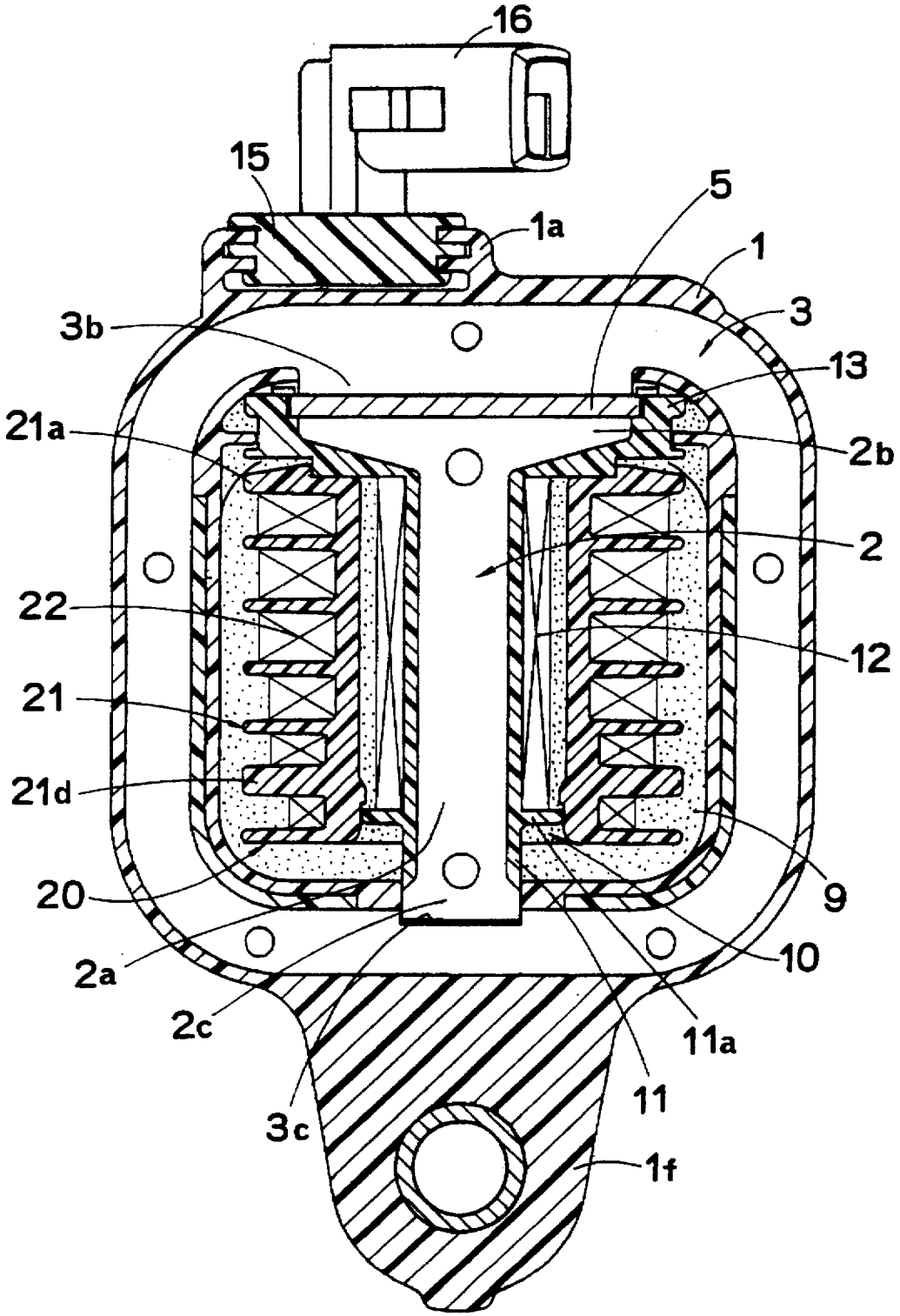
FIG. 1 is a laterally sectioned view of an ignition coil according to an embodiment of the present invention.
Figure 2:
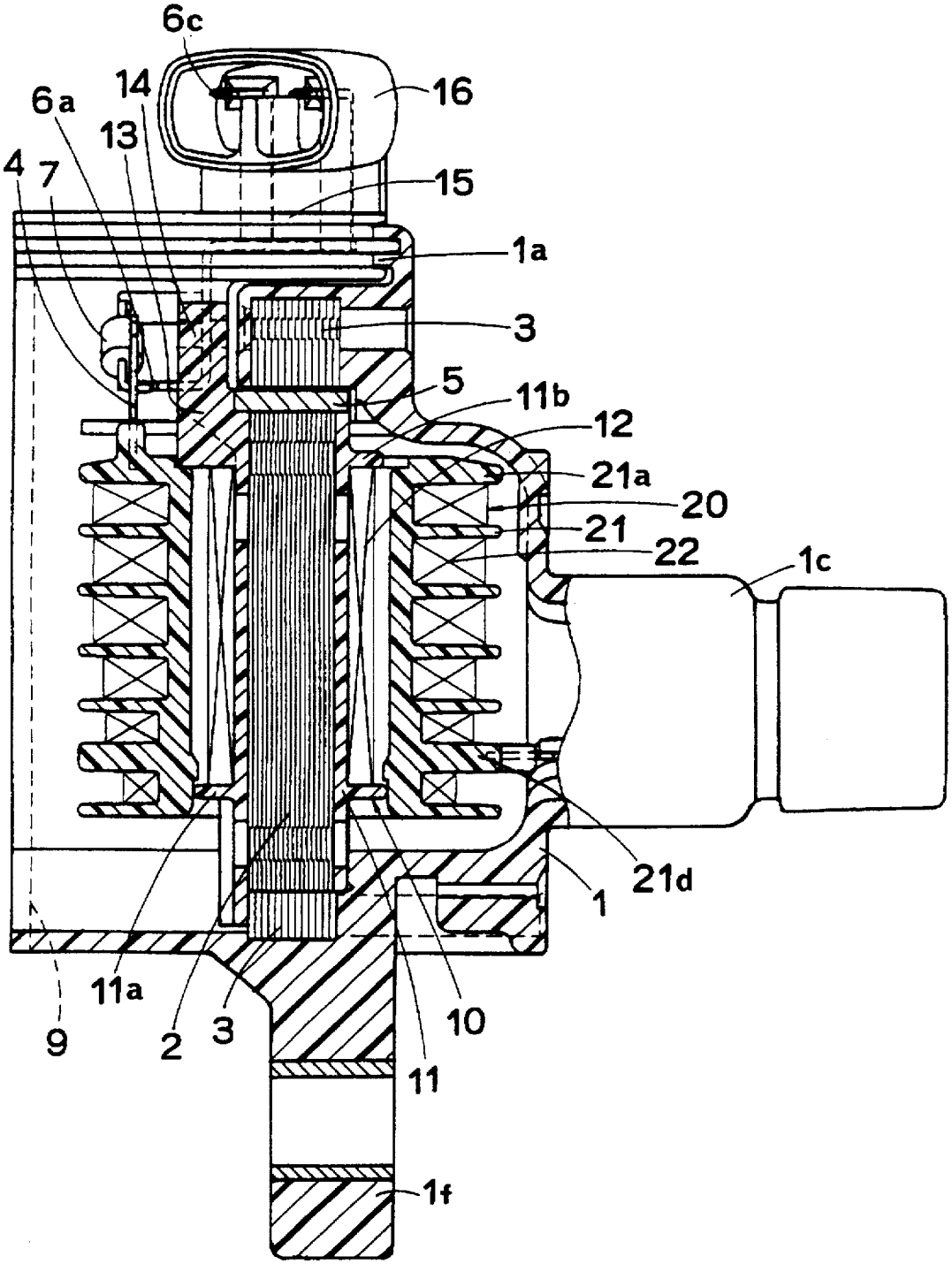
FIG. 2 is a longitudinally sectioned view of an ignition coil according to an embodiment of the present invention.

Referring to FIGS. 1 and 2, there is illustrated an ignition coil according to an embodiment of the present invention. In a housing 1, a core 2 having a T-shaped configuration and a rectangular ring-like core 3 are accommodated to constitute a magnetic circuit approximate to a B-letter shape as shown in FIG. 1. The core 2 is accommodated in a primary coil assembly 10 and a secondary coil assembly 20, while the core 3 is disposed in the housing for encircling these assemblies.

Figure 3:
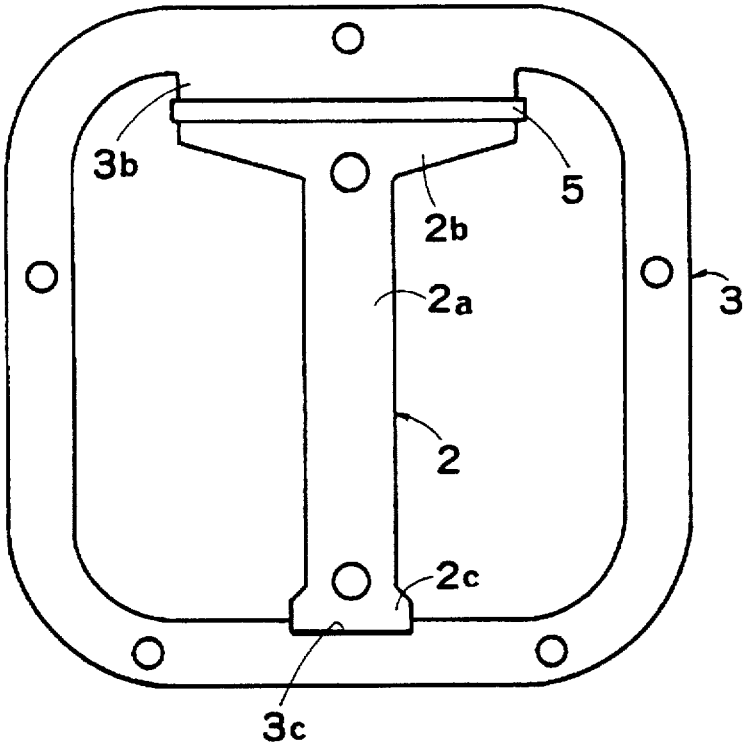
FIG. 3 is a plan view of cores and a permanent magnet positioned beth the cores according to an embodiment of the present invention.

The housing 1 is made of synthetic resin to form a box, and mold therein the core 3 to define inside thereof a space for receiving the primary coil assembly 10 and the secondary coil assembly 20. The top of the housing 1 (the left side in FIG. 2) opens, and at one side wall thereof, there is provided an opening 1*a* for receiving a support portion 15 of the primary coil assembly 10 to be fitted into the opening 1*a*, while at the other side of the housing 1, a flange portion if extends therefrom. At the bottom of the housing 1, there is formed a connecting portion 1*c*, in which a high-tension terminal (not shown) is accommodated. The core 3 which is accommodated in the housing 1 to provide the outer core according to the present invention is constituted by non-oriented silicon steel plates stacked one on the other, or laminated in the form of a rectangular ring member, for example, while it may be constituted by grain oriented silicon steel plates. As shown in FIG. 3, the core 3 has a junction portion 3*b* which is formed broad and extends inwardly to face with the core 2, and a recess 3*c* which is formed on the opposite side to the junction portion 3*b*. On the other hand, the core 2 has a columnar body portion 2*a* and a junction 2*b* which is formed integrally therewith to extend in a direction perpendicular to the axis of the body portion 2*a*, thereby to form the core 2 in a T-shaped configuration. The core 2 may be constituted by grain oriented silicon steel plates which are rolled in its axial direction and stacked one on the other,i.e., laminated. At the other side of the junction 2*b*, there is formed a junction 2*c* which is fitted into the recess 3*c* of the core 3.

The primary coil assembly 10 includes a primary bobbin 11, a holding portion 13, a connecting portion 14, a support portion 15 and a connector 16, which are made of synthetic resin, and accommodates the core 2, a pair of primary terminals (represented by 6*a*) and a pair of connector terminals (represented by 6*c*) which are molded integrally by insert-molding. The primary bobbin 11 is formed to integrally mold therein a main body of the core 2, and formed at its opposite ends with collars 11*a* and 11*b* having an approximately rectangular cross section, respectively, which are fitted into the central hollow portion of a secondary bobbin 21 which will be described later. On the primary bobbin 11, a primary winding 12 is disposed with its wire wound around the primary bobbin 11 between the collars 11*a* and 11*b* to provide two or four layers. The both ends of the primary winding 12 are connected to the respective primary terminals 6*a* and soldered on the connected portions. One of the connector terminals 6*c* is connected to a battery (not shown) and the other one of the connector terminals 6*c* is connected to a control circuit, i.e., a so-called igniter (not shown).

The holding portion 13 extends from the primary bobbin 11 to hold a permanent magnet 5 in contact with the core 2. The permanent magnet 5 is disposed to provide a magnetic flux in a direction opposite to the direction of the magnetic flux which is produced in the cores 2, 3, when the primary winding 12 is fed with the electric current. The holding portion 13 is connected integral with the support portion 15 through the connecting portion 14, in which the base portions of the primary terminals 6*a* are embedded, and the support portion 15 is connected integral with the connector 16, in which the connector terminals 6*c* are accommodated. Conductors (not shown) for electrically connecting the primary terminals 6*a* with the connector terminals 6*c* are embedded in the connecting portion 14, support portion 15 and connector 16 as indicated by phantom lines in FIG. 2.

The permanent magnet 5 which is held by the holding portion 13 is formed in a thin rectangular plate. The length of one side of the plate is slightly greater than that of one side of the junction 2*b* of the core 2 as shown in FIG. 1, and the length of the other side of the plate is slightly greater than that of the other side of the junction 2*b* as shown in FIG. 2. That is, the area of the planar surface of the permanent magnet 5 is greater than the area of the junction 2*b*, i.e., the broad end face of the core 2, so that the longitudinal ends of the junction 2*b* extend out of the junction 2*b* as shown in FIG. 1. Therefore, the permanent magnet 5 is kept in contact with the junction 2*b*,even if the permanent magnet 5 is displaced slightly.

As for the permanent magnet 5, preferably employed is a permanent magnet material of "1–5 samarium-cobalt ($Sm_1Co_5$)", which has been placed in the market. The $Sm_1Co_5$ consists of 36% samarium and 64% cobalt by mass, and has a large residual magnetic flux density and such a property as to be hardly demagnetized. The $Sm_1Co_5$ is sintered to form a magnet member of the rectangular plate, which has a thickness of greater than 1.5 mm, so that it may be formed without being broken in the later assembling process. The magnet member is assembled in the primary coil assembly 10 without being magnetized, and the magnet member is magnetized thereby to provide the permanent magnet 5 after a molding resin was filled in the housing 1, which will be described later. In assembling the permanent magnet 5 (the magnet member, in fact) into the housing 1, iron powder or the like will not be attracted to it, because it has not been magnetized, when it is assembled into the primary coil assembly 10. According to the present embodiment, the permanent magnet 5 (the magnet member) is fitted into the holding portion 13 after the primary winding 12 has been wound around the primary bobbin 11. However, the permanent magnet 5 (the magnet member) may be fitted into the holding portion 13 before the primary winding 12 is wound around the primary bobbin 11, or just before the permanent magnet 5 (the magnet member) is received in the housing 1 with the secondary coil assembly 20 assembled thereinto.

The secondary coil assembly 20 includes the secondary bobbin 21 and a secondary winding 22 disposed thereon. The secondary bobbin 21 is made of synthetic resin and formed into a cylinder with an approximately rectangular cross section, on which a plurality of collars (represented by 21*a*) are formed with a certain space between adjacent two of the collars 21*a* along the axis of the secondary bobbin 21. The wire of the secondary winding 22 is wound in each space between the collars 21*a*. A collar 21*d*, one of the collars 21*a*, is formed to have a relatively broad width, and on the collar 21*d*, at its connecting portion 1*c*'s side, a secondary terminal (not shown) is secured. The primary bobbin 11 of the primary coil assembly 10 is fitted into the hollow portion of the secondary bobbin 21, so that the primary bobbin 11 is supported at the opposite ends thereof by the secondary bobbin 21 to prevent the relative movement in the axial direction and in the direction perpendicular thereto between the primary bobbin 11 and the secondary bobbin 21. The cross sections of the primary bobbin 11 and secondary bobbin 21 may be formed in a circular shape or the like other than the rectangular shape. On one of the collars 21*a* formed at a top end of the secondary bobbin 21 in FIG. 2, there is mounted an auxiliary terminal 4 which is connected to one of the primary terminals 6*a* via a diode 7, and to which one end of the wire of the secondary winding 22 is connected and soldered. The other end of the wire of the secondary winding 22 is connected to the secondary terminal (not shown) and soldered, which terminal is connected to a high-tension terminal (not shown) in the connecting portion 1*c*.

In the case where the above-described ignition coil is assembled, the secondary coil assembly 20 is assembled into the primary coil assembly 10, and various terminals in these assemblies are connected and soldered. That is, the soldering of the terminals is made before these assemblies are received in the housing 1. When the primary coil assembly 10 and secondary coil assembly 20 are received in the housing 1, the support portion 15 of the primary coil assembly 10 is fitted into the opening 1*a* of the housing 1, and both the core 2 and the permanent magnet 5 (the magnet member) are fitted into the inside of the core 3. As a result, the permanent magnet 5 (the magnet member) contacts the laminated surface inside of the junction portion 3*b* of the core 3, and the junction 2*c* of the core 2 is fitted into the recess 3*c* of the core 3 to contact the laminated surface thereof, so that the cores 2, 3 and the permanent magnet 5 (the magnet member) are positioned in a predetermined relationship with one another. Then, a thermosetting synthetic resin such as epoxy resin is filled in the housing 1 and set to form a resin portion 9 (which is indicated by dots in FIG. 1, and the top surface of which is indicated by a phantom line in FIG. 2). Thus, the primary and secondary windings 12, 22 are impregnated and made rigid with such resin, and the insulation is ensured to endure the high-tension output from the secondary winding 22.

Figure 4:
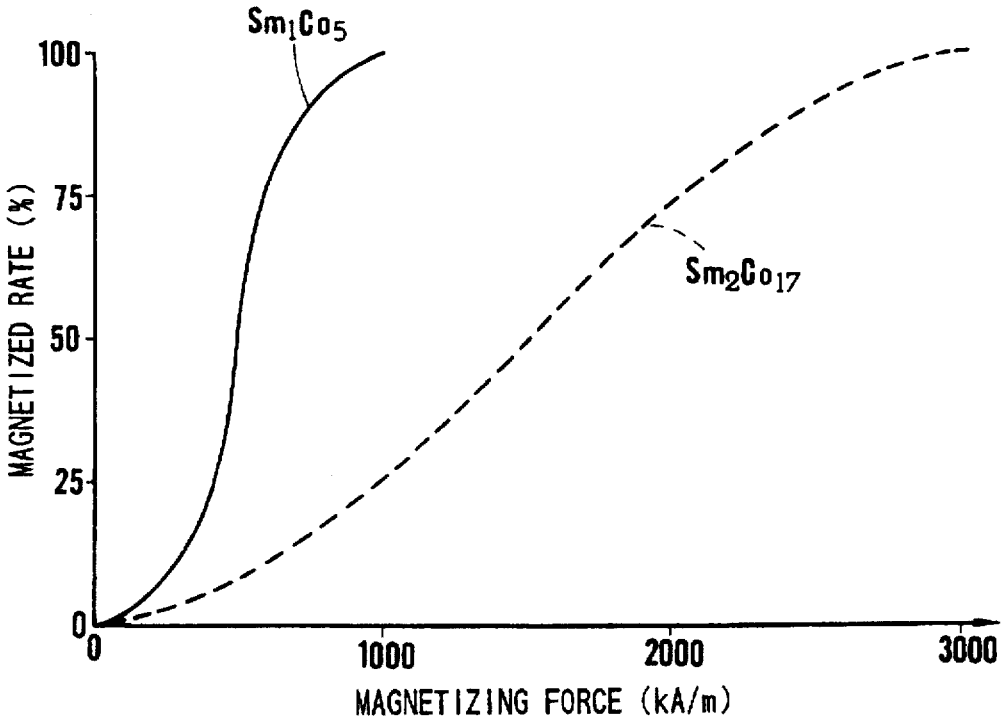
FIG. 4 is a graph showing a magnetizing property of a permanent magnet used in an embodiment of the present invention, comparing with that in the prior ignition coil.

Then, the permanent magnet 5 (the magnet member) is magnetized by a magnetizing power source (not shown). In this respect, since the permanent magnet 5 is made of $Sm_1Co_5$ and has such a magnetizing property as indicated by a solid line in FIG. 4, the permanent magnet 5 (the magnet member) is certainly magnetized by a magnetizing power source on the market, with dimensions of 1 m by 1 m by 1 m, for example, which is made by a Japanese manufacturer, Denshijiki Kogyo K. K., for example, even after the resin portion 9 was formed. According to the ignition coil as constituted above, the permanent magnet 5 has its N pole at the upper side in FIG. 1, for example, and provides a closed loop of magnetic flux in the cores 2, 3.

In operation, when a primary current is fed to the primary winding 12 through the control circuit (not shown), the magnetic flux is produced in a direction opposite to the magnetized direction by the permanent magnet 5. Then, when the primary current is cut off, a counter electromotive force is induced in the secondary winding 22, so that such a high tension as 30 to 40 kV is output from the secondary winding 22. With the permanent magnet 5 disposed between the cores 2, 3, a large magnetic flux variation is ensured. As a result, a magnetic flux density, which is produced in the primary winding 12 in response to the primary current fed thereto, becomes large to increase a discharge energy, and also the magnetic flux variation in the secondary winding 22 becomes large, so that the voltage output from the secondary winding 22 becomes large to ensure a good ignition property. This high tension is fed to the ignition plug (not shown) through the high-tension terminal (not shown), so that a spark discharge is caused at an electrode of the ignition plug to ignite a compressed air-fuel mixture in a combustion chamber (not shown).

As described above, the magnet member made of $Sm_1Co_5$ is formed as the rectangular plate having a thickness of greater than 1.5 mm to provide the permanent magnet, so that it is easily manufactured by sintering and assembled into the ignition coil without being broken. Thus, the permanent magnet material of $Sm_1Co_5$ is used with little waste, and the assembling process is efficient, to result in much decrease in cost comparing with the prior ignition coils. Furthermore, it has been constituted that the magnet member has not been magnetized when assembled, but it is magnetized to provide the permanent magnet 5 after the resin portion 9 was formed, the magnet member is not attracted by other parts, nor attracts iron powder or the like when assembled, so that it is easily assembled in the ignition coil.

It should be apparent to one skilled in the art that the above-described embodiment is merely illustrative of but one of the many possible specific embodiments of the present invention. Numerous and various other arrangements can be readily devised by those skilled in the art without departing from the spirit and scope of the invention as defined in the following claims.

What is claimed is:

1. A method of making an ignition coil comprising the steps of:

forming a core to provide a magnetic circuit;

disposing a primary winding and a secondary winding around said core;

forming a magnet member by sintering a permanent magnet material of $Sm_1Co_5$, said magnet member being formed as a plate having a thickness greater than 1.5 mm;

disposing said magnet member in said magnetic circuit;

inserting said core, said primary winding, said secondary winding and said magnet member into a housing;

molding a synthetic resin within said housing; and subsequently magnetizing said magnet member to provide a predetermined magnetic force.

2. A method of making an ignition coil comprising the steps of:

forming an inner core and an outer core a discharge port for enabling discharge form at least one of said compartments to provide a magnetic circuit;

inserting said outer core into a housing;

inserting said inner core into a bobbin;

disposing a primary winding and a secondary winding around said bobbin;

connecting a magnet member made of a permanent magnet material to said inner core;

inserting said bobbin assembled with said inner core, said magnet member, said primary winding and said secondary winding into said housing, said magnet member positioned between said inner core and said outer core;

molding a synthetic resin within said housing; and subsequently magnetizing said magnet member to provide a predetermined magnetic force.

3. The method of claim 2, further comprising the step of;

forming said magnet member as a plate made of a permanent magnet material of $Sm_1Co_5$.

4. The method of claim 3, further comprising the step of:

sintering said permanent magnet material of $Sm_1Co_5$ to form said magnet member as the plate having a thickness of greater than 1.5 mm.

5. The method of claim 4, further comprising the steps of;

forming said inner core in a T-shaped configuration;

forming said outer core in a rectangular ring shape for receiving therein said inner core with a gap formed between an inner surface of said outer core and one end face of said inner core having an area greater than an other end face of said inner core;

forming said magnet member as a rectangular plate having an area greater than said one end face of said inner core; and inserting said magnet member into said gap.

* * * * *